United States Patent [19]

Roth

[11] Patent Number: 4,560,566

[45] Date of Patent: Dec. 24, 1985

[54] METHOD OF HOT FILLING AND CLOSING A CONTAINER

[75] Inventor: Donald J. Roth, Westport, Conn.

[73] Assignee: Continental Packaging Company, Inc., Stamford, Conn.

[21] Appl. No.: 568,008

[22] Filed: Jan. 4, 1984

[51] Int. Cl.[4] ..... B65B 7/28; B65B 55/06; B65B 31/00

[52] U.S. Cl. ..... 426/399; 53/432; 53/421; 53/485; 215/232; 215/343; 220/359; 156/69; 229/43; 426/397; 426/131

[58] Field of Search ..... 426/397, 399–401, 426/407, 111, 131; 53/432, 421, 422, 404, 485; 215/232, 233, 341, 343; 220/359; 156/69

[56] References Cited

U.S. PATENT DOCUMENTS

| | | | |
|---|---|---|---|
| 78,474 | 6/1868 | Norton | 215/233 |
| 1,222,036 | 4/1917 | Schreiber | 215/233 |
| 1,280,021 | 9/1918 | Hammer | 53/421 |
| 1,842,226 | 1/1932 | Williams | 215/364 |
| 2,712,394 | 7/1955 | Koschatzky et al. | 206/315.9 |
| 2,802,322 | 8/1957 | Podesta | 53/421 |
| 3,315,872 | 4/1967 | Oarbone | 215/233 |
| 3,374,601 | 3/1968 | White | 53/421 |
| 3,517,475 | 6/1970 | Balocca | 53/432 |
| 3,819,040 | 6/1974 | Coons | 206/315.9 |
| 3,897,874 | 8/1975 | Coons | 206/315.9 |
| 4,014,723 | 3/1977 | Jones | 215/233 |
| 4,020,948 | 5/1977 | Won | 206/315.9 |
| 4,032,492 | 7/1977 | Englund et al. | 215/233 |
| 4,165,011 | 8/1979 | Holk | 220/67 |
| 4,417,667 | 11/1983 | Roth et al. | 220/67 |

*Primary Examiner*—Steven Weinstein
*Attorney, Agent, or Firm*—Charles E. Brown

[57] ABSTRACT

This relates to the hot packing of products such as food within cans. In order to permit the use of less strength cans than heretofore considered practicable, it has been necessary prior to the closing of such hot packed cans to introduce a pressurizing media such as liquid nitrogen being preferred. It is here proposed to so apply the closing end unit to the filled can so as to permit the end unit to function as a piston and to effect a pumping action when it is applied so as to permit the internal pressurization of the newly filled can without requiring any additive.

7 Claims, 14 Drawing Figures

METHOD OF HOT FILLING AND CLOSING A CONTAINER

This invention relates to the packaging of a hot product within a can and wherein, immediately after the packaging of the product, an end unit is applied to the can to seal the same.

In the past, when a hot product was packaged within a can and the appropriate end unit immediately applied, after the product finally cooled the resultant condensation of the gases caused a less than atmospheric pressure within the can to exist, and as a result one or both end units of the can would bow inwardly. No difficulties were experienced with collapsing of the can due to the high strength of the can.

In more recent years, it has been desired to reduce the wall thickness of the cans and further to form the cans of a lesser strength material than steel, such as aluminum. The result is that if a less than atmospheric pressure exists within the can, the can has a tendency radially inwardly to collapse and generally to panel. Such a can is not acceptable to the general public.

In order that the lesser strength cans may be utilized, efforts have been made to pressurize the cans at the time they are closed so that there may be a balancing of pressures within the can after the hot packed product cools. At the present this is effected by placing small amounts of liquid nitrogen within the cans and immediately thereafter sealing the cans. While the nitrogen is inert and poses no problem per se, it is difficult to control the internal pressure any closer than from 5 p.s.i. to 15 p.s.i. This, of course is in addition to the need specially to inject the liquid nitrogen.

In recent years, cans have been developed wherein ends are applied utilizing an adhesive to secure and seal the ends relative to the can bodies. However, these ends have filling and dispensing openings and the cans have been developed for products such as soft drinks and the like.

In accordance with this invention, it is proposed to make cans wherein the last applied end unit is adhesively bonded to the can body and wherein the end unit has a skirt portion which is telescoped over the open end of the can body. It has been found that by so applying the adhesive to the interior of the end unit skirt with the adhesive including an annular bead which will form an initial seal with the free end of the can body, the further application of the end unit will result in the reduction of the volume of the assembly, and thus an internal compression. By varying the effective stroke of the end unit relative to the can body, or by varying the relative capacities of the end units relative to the can bodies, the amount of air or other environmental atmosphere placed within the can, and thus the resultant compression within the can, may be varied.

At this time it is pointed out that although specific reference will hereinafter be continued to be made to cans, the invention is not restricted to cans which are made of metal, but will also include can-like components wherein the components may be formed of plastic. While in the past terms such as cans, jars, bottles and the like have defined specific identifiable structures, in recent years, in view of the different uses for different materials, these terms are no longer speficially applicable, and therefore the word can is to be considered in a generic sense.

With the above and other objects in view that will hereinafter appear, the nature of the invention will be more clearly understood by reference to the following detailed description, the appended claims, and the several views illustrated in the accompanying drawings.

Figure 5:
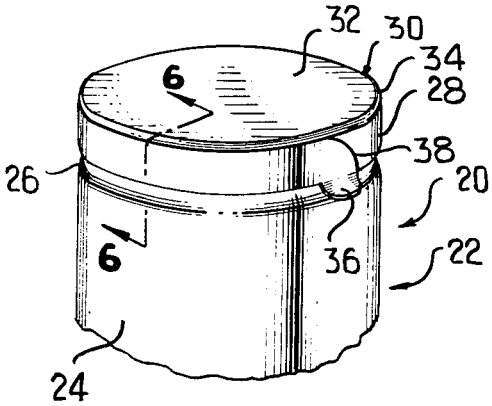
FIG. 5 is a fragmentary perspective view of the completed can.

Referring now to FIG. 5 in detail, it will be seen that there is illustrated a package which is generally identified by the numeral 20. The package 20 includes a can 22 which includes a body 24 and a bottom end (not shown). In a preferred embodiment of the can 22, the can body 24 and the bottom end may be integrally formed, although the bottom could be separately formed and secured to and sealed relative to the can body 24 in any desired manner.

The illustrated can 22 has an upper part of the body 24 necked in as at 26, and there is telescoped over this necked in portion a skirt portion 28 of an end unit or closure 30. The end unit 30 includes an end wall or panel 32 from which the skirt depends, and preferably at the corner between the skirt 28 and the end panel 32 the end unit 30 is flattened to define a line of weakness 34. The skirt 28 is provided with a pull tab 36 and is provided with a line of weakness 38 adjacent the pull tab so that the can 22 may be opened by pulling on the pull tab 36 and rupturing the skirt 28 along the weakening line 38, followed by the complete tearing off of the skirt 28.

Figure 6:
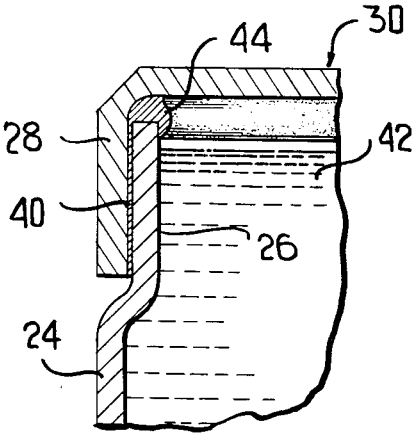
FIG. 6 is an enlarged fragmentary sectional view taken generally along the line 6—6 of FIG. 5, and shows the final sealed relationship of the end unit relative to the can.

For descriptive purposes only, the can body 24 and the end unit 30 will be formed of aluminum and the end unit 30 is secured to the can body 24 by way of an adhesive layer 40 which is shown in FIG. 6.

It is to be understood that it is conventional to place certain products within a can while the product is heated to a high temperature. Thus, when the product cools within the closed can, vapors condense and reduce the pressure within the can to the extent that not only will the end panels of the end units bow axially inwardly into the can, but also that the can body 24 will radially inwardly collapse.

In accordance with this invention, the can 22 with a product, such as the product 42, hot packed therein is closed by the end unit 30 and thereafter the end unit 30 is utilized as a piston to compress the air and other or like gases disposed within the top part of the can 22 above the hot packed product 42.

Figure 1:
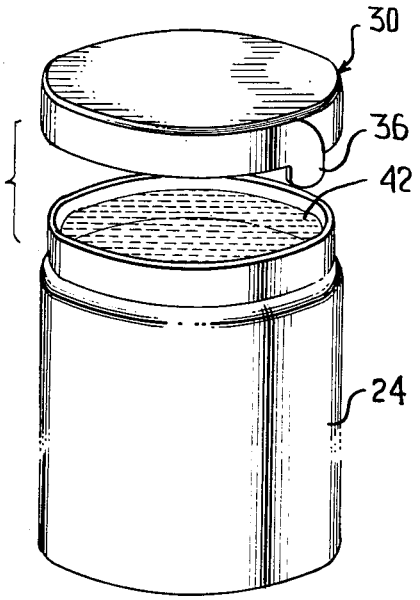
FIG. 1 is an exploded perspective view showing the upper part of a can ready to receive an end unit or closure in accordance with this invention.

In FIG. 1 there is illustrated the can body 24 filled with a hot product 42. Immediately after the hot product is placed within the can body 24, the end unit 30 is applied.

Figure 2:
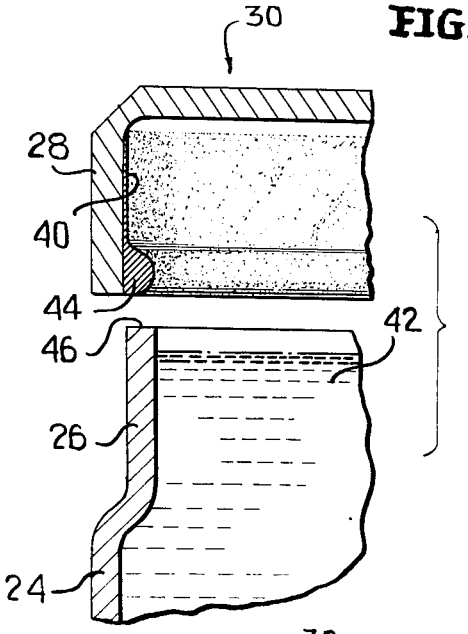
FIG. 2 is an exploded vertical sectional view taken through the upper part of the can and the closure, and shows the specific relationship between the closure, the free end of the can and adhesive carried by the closure.

Referring now to FIG. 2, it will be seen that the end unit 30 has applied to the interior of the skirt 28 thereof adhesive 40, and that the adhesive 40 includes an annular bead 44 at the extreme lower edge of the skirt 28. Thus, as soon as the skirt 28 lower edge has begun to telescope over the necked-in free end portion 26 of the can body 24, the bead 44 of adhesive will come into contact with and form a seal with the raw edge 46 at the free end 26 of the can body. This condition is shown in FIG. 3.

Figure 3:
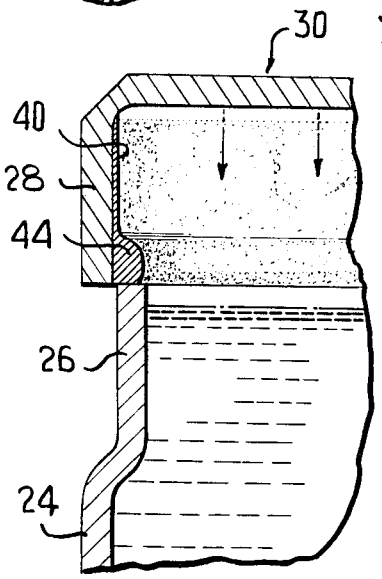
FIG. 3 is a view similar to FIG. 2, but wherein the end unit or closure has moved relative to the can and an initial seal has been formed between the end unit and the can by way of the adhesive.
Figure 4:
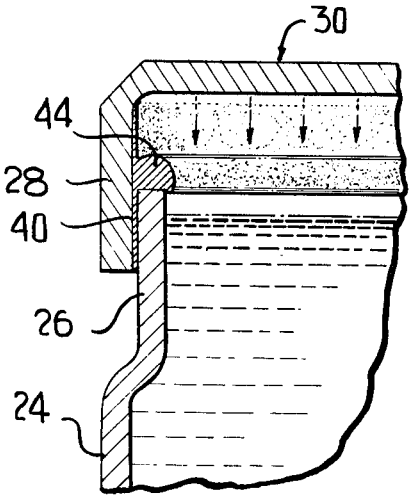
FIG. 4 is another view similar to FIG. 2, but wherein the end unit has telescoped relative to the can and the adhesive has begun to flow over and around the free or raw edge of the can.

The can 22 now being in sealed condition, when the end unit 30 is moved down onto the can body, it will function as a piston, as shown by the arrows in FIGS. 3 and 4 so as to force the air or other environmental atmosphere contained within the end unit 30 down into the can body 24. The end unit 30 will continue to move downwardly until it is in its permanent position as shown in FIG. 6. It is to be understood that the interior of the can 22 is now pressurized above atmospheric pressure.

At this time it is pointed out that the adhesive 40 may vary, although it has been found that a hot melt adhesive has functioned very satisfactorily even though normally the hot melt adhesive will be reheated after the end unit 30 has been assembled with the can body 24 and, in effect, the hot melt adhesive will become molten and will mold itself relative to the end unit and the can body.

It is also pointed out here that in certain instances the package 20 will be subjected to retorting wherein the product is heated to a temperature below the weakening temperature of the adhesive 40. When there is a further heating of the product 42, the end panel 32 may distort under certain conditions and may retain its bulged configuration. On the other hand, if one so desires, the amount of air pumped into the can may be such that it does not equal the gases placed in the can with the hot product 42 so that a slight vacuum may eventually result in the can.

At this time it is pointed out that the final internal pressure within the can will be varied depending upon the relative volume of the air or other environmental atmosphere which is pumped into the can. With respect to such other environmental atmosphere, if it is desired that the can be filled with an inert gas, the filling of the can and the closing thereof may take place within such inert atmosphere.

Figure 7:
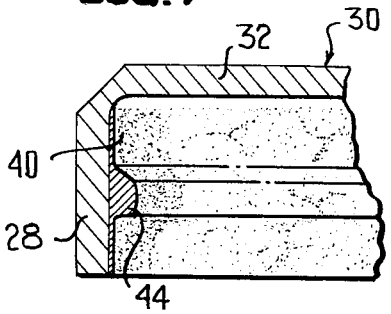
FIG. 7 is a fragmentary sectional view through a modified end unit where the adhesive bead has been moved axially into the end unit so as to reduce the volume of air or other environmental atmosphere pumped into the can.

If it is desired not to have as great a pressure within the can 22 as would occur with the combination shown in FIGS. 1–6, the amount of air or other gas pumped into the can 22 may be reduced using the end unit 30, but wherein the application of the adhesive 40 is such that the adhesive bead 44 is recessed as shown in FIG. 7. Thus, there would be a certain telescoping of the skirt 28 over the necked in free end portion 26 before the seal is effected.

Figure 8:
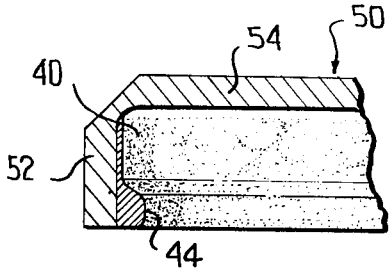
FIG. 8 is a fragmentary sectional view through another form of end unit wherein the length of the skirt has been foreshortened to reduce the pumping capacity of the end unit.

Assuming that the skirt 28 of the end unit 30 has been elongated beyond that required for the necessary adhesive bond between the skirt and the necked in end portion of the can, then an end unit having a shorter skirt may be employed. Such an end unit is shown in FIG. 8 and is identified by the numeral 50. The skirt of the end unit 50 will be identified by the numeral 52. The end panel of the end unit 50, identified by the numeral 54, will correspond to the end panel 32. It will be seen that the adhesive 40 has the annular bead 44 thereof at the lower edge of the skirt 52.

Figure 9:
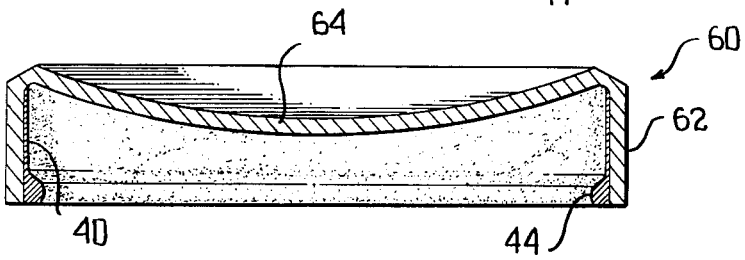
FIG. 9 is a sectional view through another form of end unit wherein the end panel thereof is bowed axially into the interior of the end unit both to reduce the pumping capacity of the end unit and to permit flexing of the end panel under internal pressure.
Figure 10:
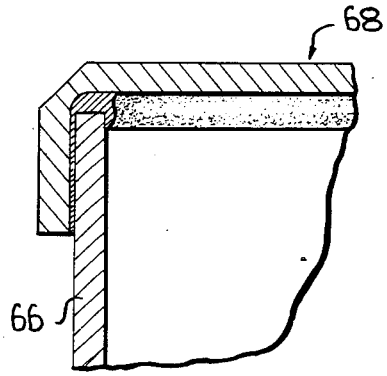
FIG. 10 shows how the pumping capacity of the end unit may be increased by increasing the cross-sectional area of the open end of the can body.
Figure 11:
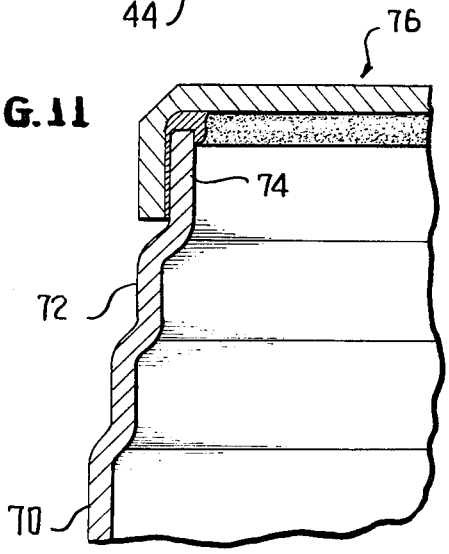
FIG. 11 is a fragmentary sectional view showing how the cross-sectional area of the end unit may be reduced as compared to the cross-sectional area of the can body so as to decrease the pumping capacity of the end unit.

In a like manner, the amount of air or other environmental atmosphere which may be pumped into the can body 24 may be reduced by an end unit 60 which is shown in FIG. 9. The end unit 60 may have a skirt 62 of the same height as the skirt 28, but in lieu of having a flat end panel, the end unit 60 is provided with an end panel 64 which is bowed into the interior of the end unit thus to reduce the volume of air or other environmental gas contained within the end unit. The skirt 62 will have the usual adhesive 40 including the adhesive bead 44 applied thereto.

The pressure within the can 22 may also be varied by varying the effective cross section of the end unit with respect to the cross section of the can body 24. In the embodiment of FIGS. 1–6, the free end portion 26 of the can body 24 is necked in so that the exterior of the skirt 28 may be flush with the exterior of the can body 24. However, if there is provided a can body 66 which is of the same cross section throughout and there is provided an end unit 68 which is of a greater cross section than the end unit 30, then the end unit 68, when applied, would pump more air or environmental gas into the can 22 and slightly increase the internal pressure over that possible with the arrangement of FIGS. 1–6. On the other hand, if there is provided a can body 70 which is triple or greater necked in as at 72 to provide an end portion 74 of a lesser diameter than the end portion 26, then the diameter of the required end unit 76 is less than that of the end unit 30 and the application of the end unit 76 would result in a lesser pressure within the can 22.

Figure 12:
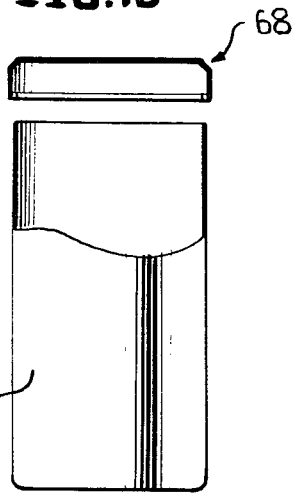
FIGS. 12, 13 and 14 are exploded elevational views with parts broken away and shown in section, showing the manner in which the pumping capacity of the end unit may be varied by varying the can body diameter versus height.
Figure 13:
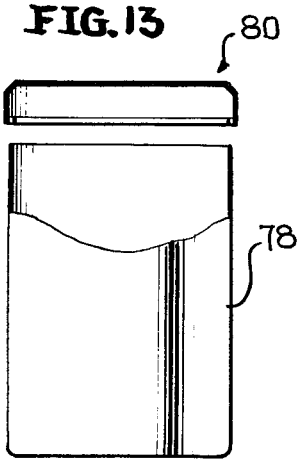
Figure 14:
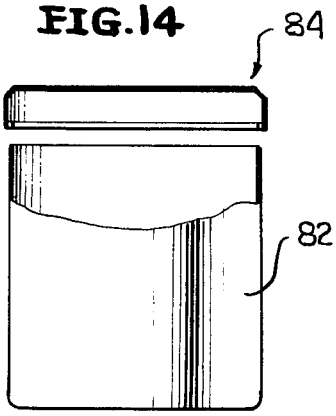

Referring now to FIGS. 12, 13 and 14, and assuming the can body 24 illustrated therein to be of a conventional diameter and height, such as 2 11/16 and 5½ inches tall, it will be seen that by increasing the diameter of the can body to a larger size can body 78 shown in FIG. 13, and foreshortening the can body, and utilizing a correspondingly larger diameter end unit 80, a greater pressure will be obtained within the can body 78 than within the can body 24. In a like manner, if there is provided a still larger diameter but shorter can body 82 to receive the same quantity of product, the required end unit 84 would be of a larger cross section than the end unit 80, and thus a still greater compression may be obtained within the can body 82.

As set forth above, while reference has been specifically made to cans, can bodies and end units, it is to be understood that various materials may be utilized in the formation of the various cans. Although aluminum is the preferred material for both the can body and the end unit, it is envisioned that the can body could be formed of steel and have one end unit secured thereto in a conventional manner such as by double seaming, while the other end unit will be applied in the manner specifically illustrated and described herein. On the other hand, the can body could be formed of a plastic material such as by blow molding and the end unit could be formed of metal, including steel, although it is preferred that it be formed of aluminum to facilitate the opening thereof.

Although only several preferred embodiments of the invention have been specifically illustrated and described herein, it is to be understood that minor variations may be made in the resultant package and the manner of forming the same without departing from the spirit and scope of the invention as defined by the appended claims.

I claim:

1. A method of controlling the pressure while a can which is filled with a hot product and closed while said product is still hot; said method comprising the steps of providing a can having a free end defining an open mouth, filling the can through the open mouth with the hot product, providing an end unit for the open mouth having an end panel and a depending skirt portion of a size to be telescoped over said open mouth in close fitting relation, applying to the interior of the skirt an annular bead of adhesive which is in a flowable state, telescoping the skirt over the can open mouth until an air tight seal is formed between the end unit and said can when the adhesive bead comes into contact with the free end defining the can open mouth, then further telescoping the end unit relative to the can to reduce the volume defined by the end unit and the can and thus effect a controlled pressurization of the interior of the can while the adhesive flows between the interior of the end unit skirt and an exterior of the can to maintain the seal between the end unit and the can, and permitting the adhesive to set and form a permanent connection between the end unit and the can.

2. The method of claim 1 wherein said controlled pressurization is controllably varied by varying the position of the adhesive bead on the end unit skirt.

3. The method of claim 1 wherein said controlled pressurization is controllably varied by varying the axial length of the end unit skirt.

4. The method of claim 1 wherein said controlled pressurization is controllably varied by varying the effective cross section of the end unit for a fixed can cross section.

5. The method of claim 1 wherein said controlled pressurization is controllably varied by selectively projecting the end panel relative to the skirt.

6. The method of claim 1 wherein said controlled pressurization is controllably varied by selectively projecting the end panel relative to the skirt into the general confines of the skirt.

7. The method of claim 1 wherein said controlled pressurization is controllably varied by the height of the can relative to the cross-sectional area of the can.

* * * * *